United States Patent [19]

Pawelko

[11] Patent Number: 4,860,623

[45] Date of Patent: Aug. 29, 1989

[54] APPARATUS FOR SEVERING A RUNNING WEB OF TIPPING PAPER OR THE LIKE

[75] Inventor: Karl-Heinz Pawelko, Marschacht, Fed. Rep. of Germany

[73] Assignee: Körber AG, Hamburg, Fed. Rep. of Germany

[21] Appl. No.: 151,556

[22] Filed: Feb. 2, 1988

[30] Foreign Application Priority Data

Feb. 5, 1987 [DE] Fed. Rep. of Germany ..... 3703463

[51] Int. Cl.[4] ..... B26D 1/62

[52] U.S. Cl. ..... 83/346; 83/343; 83/348; 83/677; 83/699

[58] Field of Search ..... 83/343, 344, 346, 348, 83/677, 699, 700

[56] References Cited

U.S. PATENT DOCUMENTS 3,703,117 11/1972 Matthews ..... 83/677

4,240,313 12/1980 Gillespie ..... 83/343

4,485,710 12/1984 Schlisio et al. ..... 83/346

*Primary Examiner*—Donald R. Schran

*Attorney, Agent, or Firm*—Peter K. Kontler

[57] ABSTRACT

Apparatus for severing the running web of tipping paper in a filter tipping machine has a rotary drum-shaped counterknife which cooperates with equidistant knives at the periphery of a rotary knife carrier to sever the leader of the running web at regular intervals. The knives are individually adjustable with reference to the counterknife so that their cutting edges merely contact the peripheral surface of the counterknife when they assume severing positions in planes including the axis of rotation of the counterknife, and each knife is unyieldingly held against any movement relative to the carrier when the apparatus is in actual use so that the adjusting mechanisms for the knives need not take up any of the stresses which develop when the knives cooperate with the counterknife to sever the running web.

16 Claims, 4 Drawing Sheets

APPARATUS FOR SEVERING A RUNNING WEB OF TIPPING PAPER OR THE LIKE

BACKGROUND OF THE INVENTION

The invention relates to apparatus for severing running webs of paper or the like, and more particularly to improvements in apparatus which can be utilized to sever running webs of tipping paper or the like in tobacco processing machines, especially in filter tipping machines wherein plain cigarettes and filter plugs are assembled into filter cigarettes of unit length or multiple unit length. Certain machines of such type are known as MAX and MAX S (distributed by the assignee of the present application). Reference may be had, for example, to commonly owned U.S. Pat. No. 4,177,670 to Heitmann et al. which discloses a filter tipping machine wherein pairs of plain cigarettes are connected with filter mouthpieces of multiple unit length by rolling therearound adhesive-coated uniting bands which are obtained in response to repeated severing of the leader of a running web of tipping paper consisting of cigarette paper, imitation cork or other suitable flexible strip material.

Commonly owned U.S. Pat. No. 4,503,867 to Barbe et al. discloses an apparatus which is designed to sever a running web of tipping paper and wherein the cutting edges of a set of knives on a rotary knife carrier cooperate with a rotary drum-shaped counterknife to sever the running web of tipping paper at regular intervals. The web is trained over and is advanced by the peripheral surface of the counterknife, and its leader is severed whenever the cutting edge of a knife reaches the nip of the counterknife and the drum-shaped knife carrier. The apparatus of Barbe et al. includes individual adjusting means for each knife and a common adjusting device for all of the knives. Individual adjusting means are desirable for initial adjustment of a new knife or a reinserted knife. The common adjusting device is used to simultaneously compensate for wear upon all of the knives, for example, after each shift. Each knife is tiltable in its carrier and has at least some freedom of movement relative to the carrier and relative to the counterknife during each stage of operation of the patented apparatus.

A different apparatus for severing running webs of tipping paper is disclosed in commonly owned U.S. Pat. No. 3,340,757 to Rudszinat. The apparatus of Rudszinat is designed in such a way that each adjustment of the knives with reference to their carrier necessitates removal of the carrier from the filter tipping machine and installation of the removed carrier in a specially designed device (shown in FIG. 8 of the patent) serving to ensure accurate positioning of each tiltably mounted knife prior to reinsertion of the carrier into the filter tipping machine. Tiltable mounting of knives in their carrier was considered desirable and advantageous because the cutting edge of each knife can find its way into full contact with the peripheral surface of the counterknife as a result of pivoting of the knife with reference to the carrier. This renders it necessary to mount the knives in such a way that they have at least some freedom of movement relative to their carrier, even when the apparatus is in actual use. Knives which are free to pivot relative to the carrier will strike against the counterknife with a force which is proportional to the action of centrifugal force (i.e., proportional to the RPM of the carrier) so that the peripheral surface of the counterknife and the cutting edges of the knives are subject to extensive wear, especially in a modern filter tipping machine which is designed to turn out many thousands of rod-shaped articles per minute.

OBJECTS AND SUMMARY OF THE INVENTION

An object of the invention is to provide an apparatus for severing running webs of tipping paper or the like which exhibits all advantages of heretofore known apparatus but is designed in such a way that the wear upon the knives and upon the counterknife is much less pronounced than in heretofore known apparatus.

Another object of the invention is to provide novel and improved means for adjusting the knives relative to their carrier and to provide novel and improved means for simultaneously adjusting all of the knives with reference to the counterknife.

A further object of the invention is to provide a novel and improved knife carrier for use in the above outlined apparatus.

An additional object of the invention is to provide a novel and improved method of adjusting the knives relative to their carrier and of maintaining the knives in optimum positions with reference to the counterknife.

Still another object of the invention is to provide novel and improved means for holding the knives against stray movements in actual use of the severing apparatus.

An additional object of the invention is to provide the apparatus with novel and improved means for adjusting the knives relative to their carrier as well as for performing at least one additional useful function.

The invention is embodied in an apparatus for subdividing a running web (particularly a web of so-called tipping paper in a filter tipping machine wherein plain cigarettes and filter mouthpieces are assembled into filter cigarettes) into discrete sections (sections of tipping paper are called uniting bands). The apparatus comprises a rotary knife carrier, a counterknife which is adjacent and defines with the carrier a path for the running web, a plurality of adjustable knives on the carrier, and novel and improved means for positioning the knives with reference to the carrier. The positioning means comprises discrete adjusting means for each of the knives, and each such adjusting means includes means for moving the respective knife substantially radially of the carrier and into a (predetermined) position of abutment with the counterknife so that, in the absence of a web in the aforementioned path, the counterknife barely contacts and exerts negligible pressure upon the cutting edge of the knife once during each revolution of the carrier. The positioning means further comprises means for unyieldingly (but preferably releasably) holding the knives in the predetermined positions so that the knives are compelled to cut across the web in the afore-mentioned path when the carrier is driven to orbit the knives about its axis of rotation and the web is caused to advance along its path.

The counterknife preferably includes a rotary drum-shaped conveyor for the web and has a cylindrical peripheral surface which abuts each of the knives once during each revolution of the carrier in the absence of a web in the path and while the knives are held in their predetermined positions with reference to the carrier.

The carrier preferably comprises a substantially drum-shaped body having a peripheral surface with substantially radially extending axially parallel sockets, one for each of the knives. The cutting edges of the knives extend from the respective sockets and abut the cylindrical peripheral surface of the rotary counterknife (conveyor of the web) once during each revolution of the carrier in the absence of a web in the path and while the knives assume their predetermined positions with reference to the carrier.

The positioning means preferably further comprises means for deactivating the holding means so as to permit substantially radial movements of the knives relative to the carrier. The adjusting means of such positioning means can comprise means (e.g., cams and coil springs) for permanently urging the respective knives substantially radially of the carrier and against the counterknife so that the knives move relative to the carrier to assume their predetermined positions (except, of course, if the knives already assume such predetermined positions) in response to deactivation of the holding means.

In accordance with one embodiment of the apparatus, the holding means includes means for clamping the knives in the predetermined positions, and such clamping means is supported by the carrier. For example, the clamping means can comprise at least one mobile first clamping element for each knife, at least one second clamping element for each knife (the second clamping elements are preferably rigid with an can constitute integral parts of the carrier, and each knife has a portion which is disposed between the respective first and second clamping elements), and means for moving the first clamping elements relative to the carrier (and hence relative to the respective second clamping elements) to and from operative positions in which the afore-mentioned portions of the knives are frictionally engaged and unyieldingly held by the respective first and second clamping elements. In accordance with a presently preferred design of the just discussed clamping means, such clamping means comprises a pair of first clamping elements for each knife and the carrier defines for the first clamping elements cam tracks which are inclined with reference to the axis of rotation of the carrier. The moving means of such clamping means include a rotary tensioning device for each pair of first clamping elements. The tensioning devices are rotatable relative to the carrier to thereby move the first clamping elements of the respective pairs along the corresponding cam tracks toward and away from each other substantially in the axial direction of the carrier. The arrangement can be such that the clamping elements of a pair of first clamping elements bear against the respective knife and urge the latter against the corresponding second clamping element or elements in response to rotation of the associated tensioning device in a direction to move the first clamping elements toward each other. Each tensioning device can comprise or constitute a screw having a head which abuts one first clamping element of the respective pair, and a threaded portion which mates with the other first clamping element of the respective pair. Each knife can resemble or constitute a substantially flat blade having a first side adjacent the respective second clamping element or elements and a second side disposed opposite the first side and adjacent the respective first clamping element or elements.

Each adjusting means can include a first cam which is movable substantially radially of the carrier to thereby move the respective knife away from the axis of the carrier, and a second cam which is movable substantially axially of the carrier to thereby move the first cam radially of the carrier. Each such adjusting means can further comprise means (e.g., a coil spring) for yieldably biasing the respective second cam against the respective first cam. Thus, when the holding means is deactivated, the biasing means are free to bias the respective knives radially outwardly so that the cutting edges of the knives come into abutment with the counterknife when the knives are in predetermined angular positions, namely when they extend radially of and are nearest to the counterknife (it being assumed here that the counterknife is a rotary drum-shaped conveyor).

In accordance with a second presently preferred embodiment, the apparatus comprises positioning means wherein the holding means are integral with the adjusting means. In such apparatus, each adjusting means comprises at least one cam which is adjacent the rear edge face of the respective knife (such rear edge faces are located in the respective sockets of the carrier), and means for moving the cam relative to the respective knife to thereby move the knife substantially radially of the carrier. The rear edge faces of the knives are or can be convex, and each adjusting means preferably comprises a pair of cams for the respective knife. The moving means of such adjusting means preferably include means for moving the cams of the respective pairs toward each other to thereby move the respective knives substantially radially of and away from the axis of rotation of the carrier. The carrier preferably defines for each pair of cams a track which is substantially parallel with the axis of rotation of the carrier. The moving means can include a rotary tensioning member for each pair of cams. Each tensioning member can comprise a head which abuts one cam of the respective pair and a threaded portion which mates with the other cam of the respective pair. The just discussed moving means (including the tensioning members) can constitute the holding means of the integral holding and adjusting means in that the connection between each moving means and the respective pair of cams is self-locking so that the cams cannot change their positions relative to the respective knives and relative to the carrier unless the moving means are rotated relative to the carrier.

The axis of rotation of the drum-shaped counterknife or conveyor is preferably parallel to the axis of rotation of the carrier. In accordance with an additional feature, the apparatus can comprise means for moving one of these axes nearer to or further away from the other axis. For example, the just mentioned moving means can include a support (e.g., a pair of levers) for the carrier and a fulcrum for the support. The fulcrum defines a third pivot axis which is parallel to the axes of the counterknife and carrier, and the support can perform a pendulum movement about the third axis to move the peripheral surface of the carrier nearer to or further away from the peripheral surface of the counterknife. Such adjustment of the entire carrier can be resorted to in order to compensate for unavoidable wear upon the knives.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
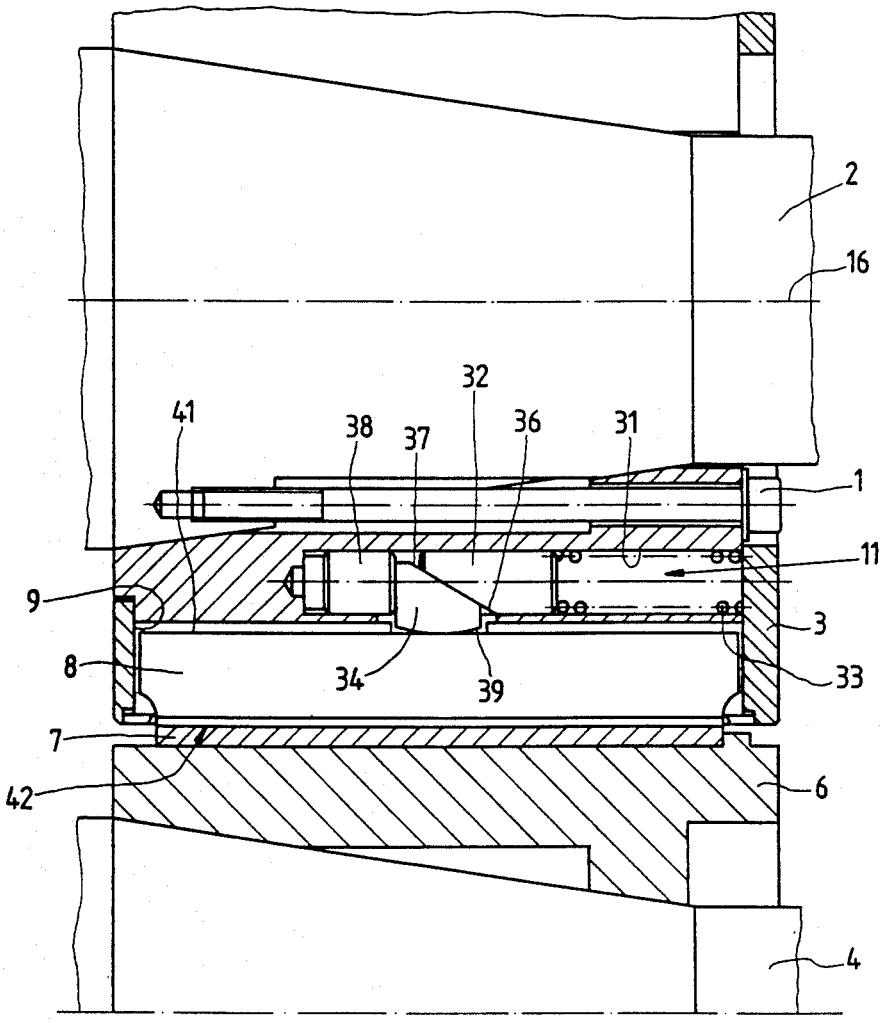
FIG. 1 is a fragmentary axial sectional view of a carrier and a counterknife in an apparatus which embodies one form of the invention and wherein the holding means of the positioning means is not integrated into the adjusting means, one of the adjusting means being shown in a position in which the cutting edge of the respective knife abuts the peripheral surface of the drum-shaped counterknife.
Figure 2:
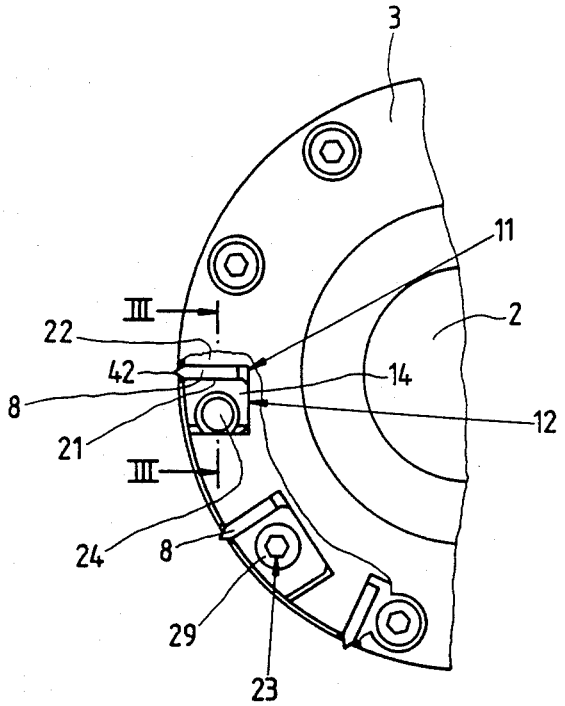
FIG. 2 is a smaller-scale fragmentary end elevational view of the carrier and of some of the knives as seen from the left-hand side of FIG. 1.
Figure 3:
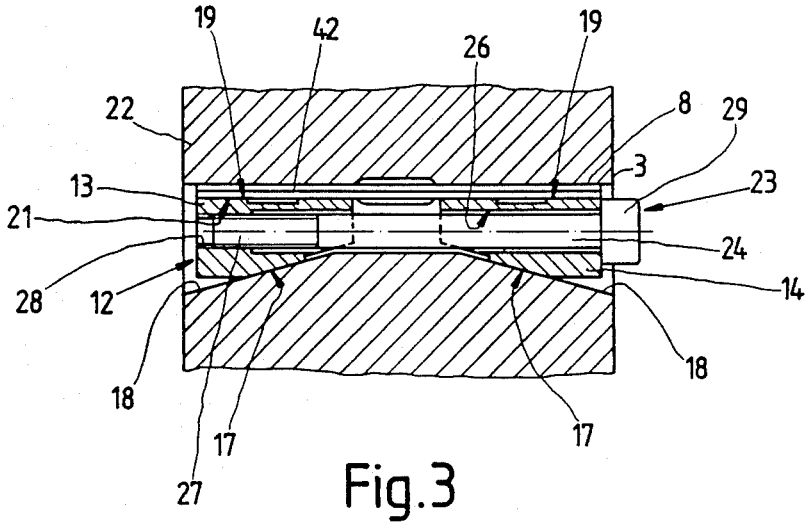
FIG. 3 is an enlarged fragmentary sectional view as seen in the direction of arrows from the line III—III of FIG. 2 and shows the holding means for one of the knives.

FIGS. 1 to 3 show a first embodiment of a severing apparatus which is constructed and assembled in accordance with the invention and wherein a hollow drum-shaped carrier 3 for a set of equidistant knives 8 is non-rotatably affixed to a drive shaft 2 by a set of fasteners 1 (one shown) so as to rotate about a horizontal or nearly horizontal axis 16. The carrier 3 cooperates with a drum-shaped conveyor 6 which constitutes a counterknife for the knives 8 and is affixed to a drive shaft 4 so as to rotate about an axis which is parallel to the axis 16 of the carrier 3. The counterknife 6 is provided with a cylindrical sleeve 7 which is made of a wear-resistant material and whose cylindrical peripheral surface defines with the carrier 3 a path for a running web (not shown) of tipping paper. One side of the web is coated with adhesive so that successive uniting bands (which are obtained in response to repeated severing of the leader of the web by the cutting edges 42 of successive knives 8) can be convoluted around and can adhere to groups of coaxial rod-shaped articles on a wrapping conveyor of the filter tipping machine in which the improved apparatus is put to use. The peripheral surface of the sleeve 7 contacts and entrains the uncoated side of the running web.

The body of the carrier 3 has a preferably cylindrical peripheral surface (see FIG. 2) which is provided with radially extending axially parallel sockets 9 in the form of narrow slots, one for each knife 8. Each knife 8 has an inner portion which is disposed in the respective socket 9, and the cutting edge 42 of each knife 8 extends beyond the peripheral surface of the carrier 3 so that it can contact the cylindrical peripheral surface of the sleeve 7 of the counterknife 6 when the parts 3 and 6 are driven in the absence of a web of tipping paper in the aforementioned path. It is often desirable to drive the counterknife 6 at a peripheral speed which slightly exceeds the speed of the cutting edges 42 and to cause the peripheral surface of the sleeve 7 to slip relative to the web of tipping paper; this ensures that successively formed uniting bands are automatically separated from the leader of the running web of tipping paper in actual use of the severing apparatus. The sleeve 7 is or can be provided with suction ports which attract the uniting bands and the leader of the running web at the severing station.

In accordance with a feature of the invention, the apparatus of FIGS. 1 to 3 comprises a novel and improved positioning means for the knives 8, and such positioning means comprises discrete adjusting means 11 for each knife and discrete holding means 12 serving to unyieldingly hold the knives 8 in positions which are selected therefor by the respective adjusting means 11. Each of the holding means 12 is designed to oppose and prevent any movements of the respective knife 8 relative to the carrier 3 when the severing apparatus is in actual use, i.e., it is no longer necessary to ensure that the knives 8 will be free to pivot relative to the carrier 3.

Each of the holding means 12 comprises two movable first clamping elements 13, 14 (FIG. 3), a second clamping element 22 which is rigid with (and is or can constitute an integral part of) the carrier 3, and means 23 for moving the clamping elements 13, 14 relative to the respective clamping element 22 as well as relative to that portion of the respective knife 8 which is disposed between the clamping elements 13, 14 on the one hand and the clamping element 22 on the other hand. The illustrated knives 8 are or can include blades each of which has a first side 21 adjacent the respective second clamping element 22 and a second side opposite the first side 21 and adjacent the respective first clamping elements 13, 14. The carrier 3 defines for the clamping elements 13, 14 elongated tracks 17 which are provided in cutouts 18 of the carrier and are inclined relative to each other as well as with reference to the axis 16 so as to ensure that the clamping elements 13, 14 will bear against the respective side of the knife 8 with a progressively increasing force when the respective moving means 23 is rotated relative to the carrier 3 in a direction to move the clamping elements 13, 14 axially of the carrier and toward each other. To this end, each moving means 23 includes a rotary tensioning device in the form of an elongated screw which has a head 29 abutting the outer end of the clamping element 14, an elongated shank 24 which extends through a bore 26 of the clamping element 14, and an externally threaded portion 27 which extends into a tapped bore 28 of the clamping element 13. When the tensioning device 23 of FIG. 3 is rotated in a direction to move the clamping elements 13, 14 nearer to each other, their surfaces 19 slide along the respective side of the adjacent knife 8 and the side 21 of the knife is urged against the clamping element 22 so that the knife portion between the clamping elements 13, 14 and 22 is unyieldingly held against any movement relative to the carrier 3, i.e., the position of the cutting edge 42 is fixed and remains unchanged unless the holding means 12 is deactivated by the tensioning device 23, namely in response to rotation of the shank 24, head 29 and externally threaded portion 27 in a direction to move the clamping elements 13, 14 axially of the carrier 3 and away from each other.

Each adjusting means 11 is designed to automatically urge the respective knife 8 radially of and away from he axis 16 of the carrier 3 in response to deactivation of the respective holding means 12. As shown in FIG. 1, each adjusting means 11 comprises a first cam 34 which is installed in the carrier 3 radially inwardly of the respective socket 9 and has a convex face 39 which abuts the rear edge face 41 of the respective knife 8 under the action of a coil spring 33 and through the intermediary of a second cam 32. The coil spring 33 is installed in an axially parallel bore 31 of the carrier 3 and serves as a means for permanently biasing the cam 32 in a direction to the left, a seen in FIG. 1, so that a suitably inclined cam face 36 of the cam 32 bears against a complementary cam face 37 of the cam 34 and urges the latter radially outwardly (away from the axis 16) under the action of the coil spring 33. The cam 34 is held against any movement away from the coil spring 33 by a preferably adjustable stop 38 in the carrier 3.

The bias of the coil spring 33 and the inclinations of the cam faces 36, 37 are selected in such a way that the cam 34 biases the cutting edge 42 of the knife 8 against the cylindrical peripheral surface of the sleeve 7 with a relatively small force, i.e., the cutting edge 42 barely contacts the peripheral surface of the sleeve 7 when the respective knife 8 assumes the angular position of FIG. 1, namely in the nip of the carrier 3 and counterknife 6. Thus, if the respective holding means 12 is deactivated by rotating the tensioning device 23 in a direction to move the clamping elements 13, 14 away from each other, the spring 33 is immediately free to effect a movement of the entire cutting edge 42 into contact with the sleeve 7 when the knife 8 is moved to the angular position of FIG. 1. The tensioning device 23 is thereupon rotated in the opposite direction to ensure that the respective clamping elements 13, 14 cooperate with the clamping element 22 in order to reliably (unyieldingly) hold the knife 8 in the thus determined optimum position in which the sleeve 7 barely touches the cutting edge 42 once during each revolution of the carrier 3 and while the aforementioned path does not contain a length of tipping paper.

The apparatus of FIGS. 1 to 3 can be provided with means for varying the initial stressing of the coil springs 33 so as to allow for a selection of the magnitude of force with which the convex face 39 of each cam 34 bears against the rear edge face 41 of the respective knife 8 when the corresponding holding means 12 is deactivated by its tensioning device 23. The bias of the springs 33 should suffice to ensure that, when a holding means 12 is deactivated and the corresponding knife 8 assumes the angular position of FIG. 1, the entire cutting edge 42 of such knife contacts the peripheral surface of the sleeve 7 without play (in the absence of a web of tipping paper in its path).

An important advantage of the positioning means including the adjusting means 11 and the holding means 12 of FIGS. 1 to 3 is that the adjusting means 11 are not called upon to stand any stresses which arise in the course of a cutting or severing operation. Thus, all such stresses are taken up by the corresponding holding means 12 in that the mobile first clamping elements 13, 14 cooperate with the respective second clamping elements 22 to unyieldingly hold the knives 8 against any movement relative to the carrier 3 when the apparatus is in actual use. This renders it possible to employ relatively weak springs 33 or to employ springs 33 which store a relatively small amount of energy because such springs are merely called upon to ensure that the cutting edges 42 barely touch the sleeve 7 when the respective holding means 12 are deactivated and the knives 8 are held in the angular positions corresponding to that of the knife 8 shown in FIG. 1.

An advantage of the improved apparatus is that the wear upon the cutting edges 42 of the knives 8 and upon the sleeve 7 of the counterknife 6 is reduced to a minimum. This is due to the fact that the knives 8 are not permitted to move relative to the carrier 3 when the apparatus is in actual use. Such absence of any movement of the knives 8 relative to the carrier 3 is desirable on the additional ground that the apparatus produces a minimum of noise (because the cutting edges 42 of the knives 8 cannot strike against the peripheral surface of the sleeve 7 with a force which is a function of the RPM of the carrier 3). Moreover, each cutting edge 42 makes a clean cut across the entire web of tipping paper in spite of the fact that it is barely contacted by the peripheral surface of the sleeve 7 once during each revolution of the carrier 3.

The apparatus of FIGS. 1 to 3 exhibits the additional advantage that the entire cutting edge 42 of each knife 8 is automatically compelled to move into contact with the peripheral surface of the sleeve 7 as soon as the respective holding means 12 is deactivated, i.e., as soon as the respective tensioning device 23 is rotated in a direction to terminate the frictional engagement between the sides of the knife and the respective clamping elements 13, 14 and 22 so that the spring 33 is free to bring about a radially outward movement of the knife 8 (in the angular position of FIG. 1) until the cutting edge 42 moves into full contact with the peripheral surface of the sleeve 7. When the apparatus is idling (i.e., when the knives 8 are caused to orbit about the axis 16 of the carrier 3 while the path for the web of tipping paper is empty), the noise is negligible because the cutting edges 42 of successive knives 8 merely contact but do not actually strike against the peripheral surface of the sleeve 7. Such mode of operation of the apparatus ensures a long useful life of the knives 8 and of the sleeve 7 so that the number of intervals of idleness of the filter tipping machine (for the purpose of replacing one or more defective knives 8) is reduced to a minimum. On the other hand, the holding means 12 ensure that the knives 8 cannot yield when the apparatus is used to sever a running web so that each knife is compelled to make a clean cut across the entire web whenever such knife moves to the position corresponding to that of the knife which is shown in FIG. 1.

Figure 4:
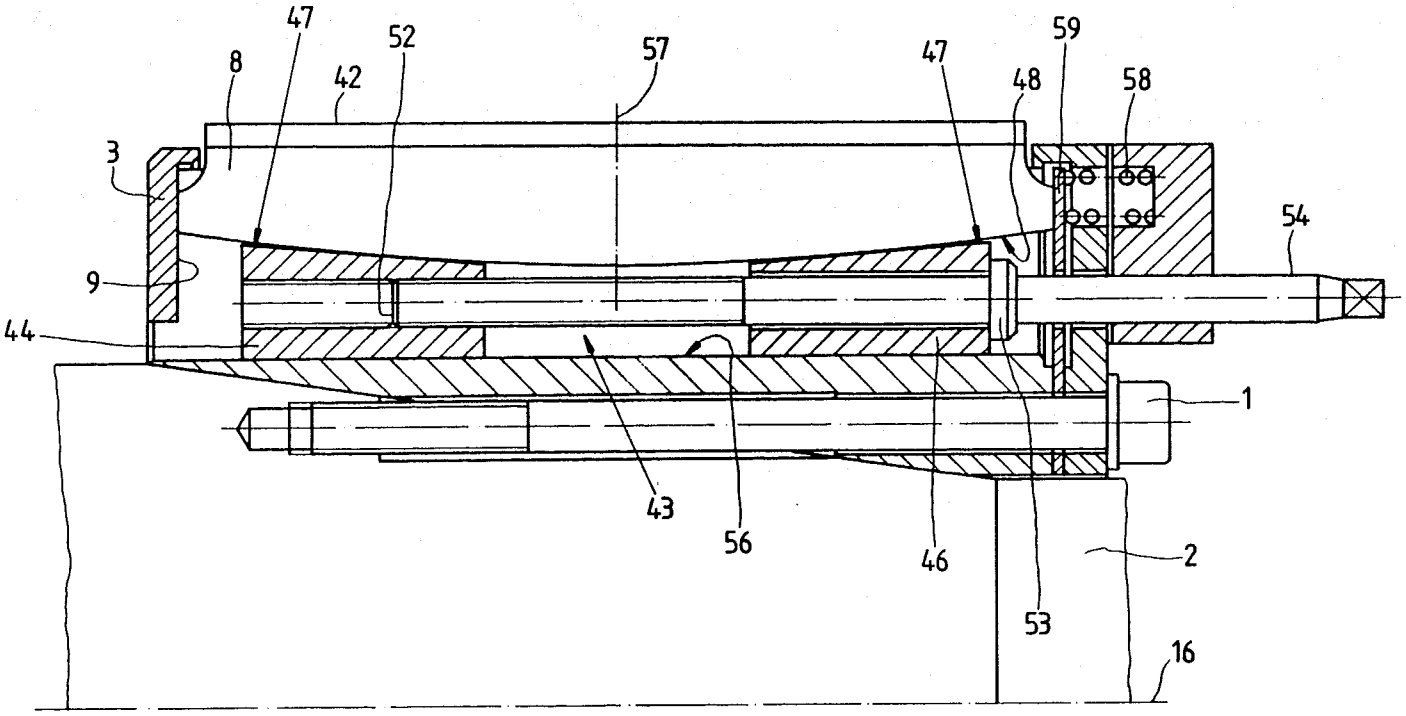
FIG. 4 is a fragmentary axial sectional view of a carrier forming part of an apparatus wherein the holding means for the knives are integrated into the adjusting means.

FIG. 4 shows a portion of a modified apparatus wherein the holding means are integrated into the adjusting means for the knives 8 to jointly form a positioning means 43. Each adjusting means comprises two cams 44, 46 and a moving means 54 serving to move the cams 44, 46 in parallelism with the axis of the carrier 3 toward or away from each other. The cams 44, 46 are movable along a track 56 which is defined by the carrier 3, and such cams are disposed at opposite sides of an axis 57 which is located midway between the axial ends of the carrier. The cams 44, 46 have cam faces 47 which are in contact with the convex rear edge face 48 of the respective knife 8 which is radially movably mounted in the respective socket 9 of the carrier 3.

The moving means 54 constitutes the holding means for the adjusting means which is shown in FIG. 4 and includes a rotary tensioning member having a head 53 in abutment with the outer end face of the cam 46, a shank which is received in a bore of the cam 46, and an externally threaded portion 52 in a tapped bore of the cam 44.

When a fresh (unused) knife 8 is inserted into the respective socket 9, the corresponding tensioning member 54 is rotated in a sense to move the knife radially outwardly until the cutting edge 42 of the knife abuts the peripheral surface of the sleeve 7 of the counterknife 6 (not shown in FIG. 4) while the knife 8 extends substantially radially of the counterknife (i.e., while the knife assumes an angular position corresponding to that of the knife 8 which is shown in FIG. 1). The convex rear edge face 48 of the knife 8 permits a tilting of the knife (if necessary) until the entire cutting edge 42 abuts the peripheral surface of the sleeve 7. In other words, the knife 8 is free to float on the faces 47 of the respective cams 44, 46 so as to assume an optimum position relative to the counterknife before the tensioning member 54 is brought to a halt to thereby hold the knife 8 in the predetermined position in which the entire cutting edge 42 abuts the sleeve 7. Uncontrolled stray movements of the knife 8 relative to the carrier 3 are prevented by a disc-shaped retaining member 59 which can be made of elastic metallic sheet stock (e.g., spring steel) and is biased against one end face of each knife 8 by a set of coil springs 58 (one shown in FIG. 4) each of which is recessed in the respective end portion of the carrier 3 and bears against the retaining member 59 to thereby urge the other end face of the knife 8 against the carrier 3.

An advantage of the cams 44, 46 is that each thereof can take up one-half of stresses which develop while the respective knife 8 is called upon to sever the running web of tipping paper, i.e., when the respective knife 8 is disposed in the nip of the carrier 3 and the counterknife 6. As shown in FIG. 4, the cams 44, 46 of each adjusting means are disposed at opposite sides of the axis 57 so that they contact mirror symmetrical portions of the convex rear edge face 48 of the respective knife 8.

The bias of the springs 58 suffices to ensure that the knives 8 are held against abrupt or gradual radially outward movement under the action of centrifugal force when the carrier 3 rotates. In other words, the rear edge face 48 of each knife 8 remains in contact with the faces 47 of the corresponding cams 44, 46 when the apparatus of FIG. 4 is in actual use.

The apparatus of FIG. 4 exhibits the advantage that its positioning means 43 comprises a small number of parts because each tensioning member 54 constitutes an element of the respective adjusting means as well as the holding means for the respective knife 8. The self-locking action of each tensioning member 54 (combined with the bias of the springs 58) suffices to ensure that the knives 8 are unyieldingly held against any movement relative to the carrier 3 when the apparatus of FIG. 4 is in actual use.

Figure 5:
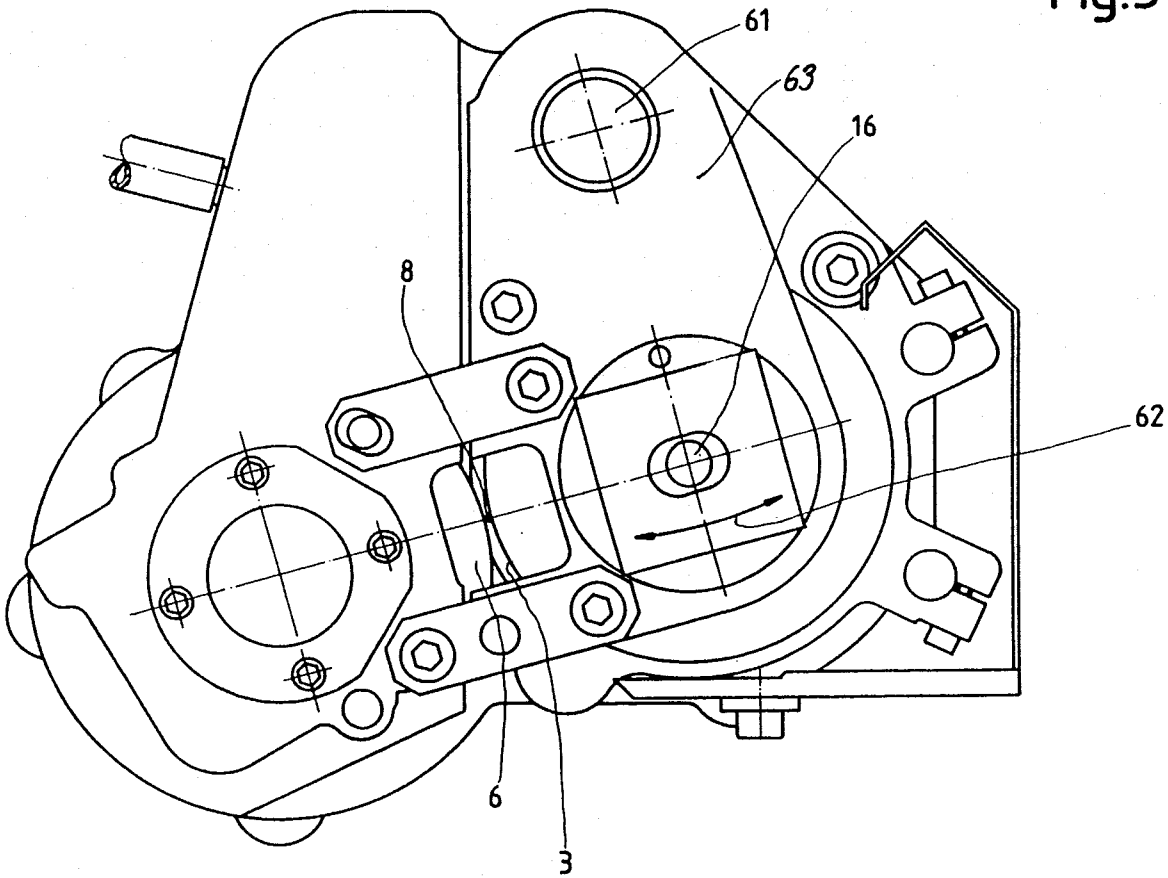
FIG. 5 is an end elevational view of a further apparatus wherein the entire carrier is pivotable relative to the counterknife to allow for simultaneous compensation for wear upon the cutting edges of all knives.

Each knife 8 is initially adjusted by the adjusting means 11 of FIGS. 1–3 or by the adjusting means of the integral adjusting and holding means of FIG. 4. The wear upon the cutting edges 42 of the knives 8 is at least substantially uniform due to uniform initial positioning of all knives relative to the sleeve 7 of the counterknife. Therefore, each subsequent adjustment of the knives 8 relative to the counterknife 6 can be carried out without individually adjusting each of the knives. As shown in FIG. 5, the end portions of the carrier 3 for the knives 8 can be mounted on two levers 63 (one shown) which are pivotable about the axis of a fulcrum 61. Such axis is parallel to the axis 16 of the carrier 3 and to the axis of the counterknife 6. The arrow 62 denotes the directions in which the carrier 3 can be moved relative to the counterknife 6 so as to move its axis 16 nearer to or away from the axis of the counterknife. All that is necessary is to move one of the knives 8 to a position in which the plane of such knife includes the plane of the axis of the counterknife 6 and to pivot the carrier 3 counterclockwise, i.e., nearer to the counterknife 6, until the cutting edge of the illustrated knife 8 abuts the peripheral surface of the sleeve 7 (not shown) on the counterknife 6. This ensures that all of the knives 8 on the carrier 3 are properly positioned with reference to the counterknife 6. Such adjustment can be carried out upon completion of each shift, i.e., after the apparatus embodying the structure of FIG. 5 has been put to use for a predetermined number of hours.

It is also possible to move the counterknife 6 relative to the carrier 3. The conduit in the upper left-hand portion of FIG. 5 serves to connect the aforediscussed suction ports in the peripheral surface of the sleeve of the counterknife 6 with a suction generating device to thus ensure that the leader of the running web of tipping paper as well as each freshly formed uniting band will adhere to the periphery of the sleeve in the region of the severing station.

Since the wear upon one of the knives 8 is expected to be the same (or practically the same) as the wear upon each other knife on the carrier 3, the arrangement of FIG. 5 renders it possible to rapidly compensate for wear upon the knives 8 without it being necessary to move each and every knife to a position in which the plane of such knife coincides with the axis of the counterknife 6. In other words, a single adjustment (pivoting) of the carrier 3 relative to the counterknife 56 of FIG. 5 suffices to compensate for wear upon the cutting edges of all knives 8, as long as the adjustment of the carrier 3 relative to (namely toward) the counterknife 6 takes place while one of the knives 8 is held in a plane which includes the axis of the counterknife 6.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for subdividing a running web, particularly a web of tipping paper in a filter tipping machine, into discrete sections, comprising a rotary knife carrier; a counterknife adjacent and defining with said carrier a path for the running web; a plurality of adjustable knives on said carrier; and means for positioning said knives with reference to said carrier, including discrete adjusting means for each of said knives, each of said adjusting means including means for moving the respective knife substantially radially of said carrier and into a position of abutment with said counterknife so that, in the absence of a web in said path, the counterknife barely contacts and exerts negligible pressure against the knife once during each revolution of the carrier, said positioning means further comprising means for unyieldingly holding the knives in said positions to that the knives cut across the web in said path, said positioning means also comprising means for deactivating said holding means so as to permit substantially radial movements of said knives, said adjusting means comprising means for permanently urging the respective knives substantially radially of said carrier and against said counterknife so that the knives move relative to said carrier to assume said positions in response to deactivation of said holding means.

2. The apparatus of claim 1, wherein said counterknife includes a rotary drum-shaped conveyor for the web and has a peripheral surface which abuts each of the knives once during each revolution of said carrier in the absence of a web in said path and while the knives are held in said positions with reference to said carrier.

3. The apparatus of claim 1, wherein said carrier includes a substantially drum-shaped body having a peripheral surface with substantially radially extending axially parallel sockets, one for each of said knives, said knives having cutting edges which abut said counterknife once during each revolution of said carrier in the absence of a web in said path and while the knives assume said positions with reference to said carrier.

4. The apparatus of claim 1, wherein said holding means includes means for clamping the knives in said positions, said clamping means being supported by said carrier.

5. The apparatus of claim 1, wherein each of said adjusting means includes a first cam movable substantially radially of the carrier to thereby move the respective knife away from the axis of said carrier, and a second cam movable substantially axially of said carrier to thereby move said first cam radially of the carrier.

6. The apparatus of claim 5, wherein each of said adjusting means further comprises means for yieldably biasing the respective second cam against the respective first cam.

7. Apparatus for subdividing a running web, particularly a web of tipping paper in a filter tipping machine, into discrete sections, comprising a rotary knife carrier; a counterknife adjacent and defining with said carrier a path for the running web; a plurality of adjustable knives on said carrier; and means for positioning said knives with reference to said carrier, including discrete adjusting means for each of said knives, each of said adjusting means including means for moving the respective knife substantially radially of said carrier and into a position of abutment with said counterknife so that, in the absence of a web in said path, the counterknife barely contacts and exerts negligible pressure against the knife once during each revolution of the carrier, said positioning means further comprising means for unyieldingly holding the knives in said positions so that the knives cut across the web in said path, said holding means including means for clamping the knives in said positions, said clamping means being supported by said carrier and including at least one mobile first clamping element for each of said knives, at least one second clamping element for each of said knives, said second clamping elements being rigid with said carrier and each of said knives having a portion between the respective first and second clamping elements, and means for moving said first clamping elements relative to said carrier to and from operative positions in which said portions of the knives are respectively engaged and unyieldingly held by the respective first and second clamping elements.

8. The apparatus of claim 7, wherein said clamping means comprises a pair of first clamping elements for each of said knives and said carrier defines for said first clamping elements cam tracks which are inclined with reference to the axis of rotation of said carrier, said moving means including a rotary tensioning device for each pair of first clamping elements, said tensioning devices being rotatable relative to said carrier to thereby move the first clamping elements of the respective pairs along the respective cam tracks toward and away from each other substantially in the axial direction of said carrier.

9. The apparatus of claim 8, wherein each of said tensioning devices comprises a screw having a head abutting one first clamping element of the respective pair and a threaded portion mating with the other first clamping element of the respective pair.

10. The apparatus of claim 8, wherein said knives include blades each having a first side adjacent the respective second clamping element and a second side adjacent the respective pair of first clamping elements.

11. Apparatus for subdividing a running web, particularly a web of tipping paper in a filter tipping machine, into discrete sections, comprising a rotary knife carrier; a counterknife adjacent and defining with said carrier a path for the running web; a plurality of adjustable knives on said carrier; and means for positioning said knives with reference to said carrier, including discrete adjusting means for each of said knives, each of said adjusting means including means for moving the respective knife substantially radially of said carrier and into a position of abutment with said counterknife so that, in the absence of a web in said path, the counterknife barely contacts and exerts negligible pressure against the knife once during each revolution of the carrier, said positioning means further comprising means for unyieldingly holding the knives in said positions so that the knives cut across the web in said path, said holding means being integral with said adjusting means.

12. The apparatus of claim 11, wherein said carrier has a peripheral surface and a plurality of axially parallel sockets in said peripheral surface, one for each of said knives, each of said knives having a cutting edge extending from the respective socket and a rear edge face in the respective socket, said integral holding and adjusting means comprising at least one cam adjacent the rear edge face of each of said knives and means for moving said cam relative to the respective knife to thereby move the knife substantially radially of the carrier.

13. The apparatus of claim 12, wherein said knives have convex rear edge faces and said integral holding and adjusting means comprise a pair of cams for each of said knives, said moving means including means for moving the cams of the respective pairs toward each other to thereby move the respective knives substantially radially of and away from the axis of rotation of said carrier.

14. The apparatus of claim 13, wherein said carrier defines for each pair of cams a track which is substantially parallel with the axis of rotation of said carrier.

15. The apparatus of claim 13, wherein said moving means includes a rotary tensioning member for each pair of cams, each tensioning member having a head abutting one cam of the respective pair and a threaded portion mating with the other cam of the respective pair.

16. The apparatus of claim 13, wherein said moving means constitute or form part of said holding means.

* * * * *